US011034483B2

(12) United States Patent
Maroofian et al.

(10) Patent No.: US 11,034,483 B2
(45) Date of Patent: Jun. 15, 2021

(54) MODULAR STORAGE SYSTEM

(71) Applicant: PinnPack Packaging, LLC, Oxnard, CA (US)

(72) Inventors: Ira Maroofian, Woodland Hills, CA (US); Dean R. Brown, La Habra, CA (US)

(73) Assignee: PINNPARK PACKAGING LLC, Oxnard (CA)

( * ) Notice: Subject to any disclaimer, the term of this patent is extended or adjusted under 35 U.S.C. 154(b) by 109 days.

(21) Appl. No.: 16/156,881

(22) Filed: Oct. 10, 2018

(65) Prior Publication Data

US 2019/0106243 A1 Apr. 11, 2019

Related U.S. Application Data

(60) Provisional application No. 62/571,154, filed on Oct. 11, 2017.

(51) Int. Cl.

| | |
|---|---|
| ***A63H 33/04*** | (2006.01) |
| ***B65D 21/02*** | (2006.01) |
| ***B65D 1/22*** | (2006.01) |
| ***B65D 85/62*** | (2006.01) |

(52) U.S. Cl.

CPC ..... *B65D 21/0204* (2013.01); *B65D 1/22* (2013.01); *B65D 21/0206* (2013.01); *B65D 85/62* (2013.01)

(58) Field of Classification Search

CPC .. B65D 21/0204; B65D 21/0206; B65D 1/22; B65D 1/30; B65D 85/62; B65D 81/361

USPC ..... 206/504; 220/23.4, 23.83, 507, 4.29, 220/4.26

See application file for complete search history.

(56) References Cited

U.S. PATENT DOCUMENTS

| | | | | |
|---|---|---|---|---|
| 3,759,371 | A | 9/1973 | Marks | |
| 4,170,082 | A * | 10/1979 | Freedman | A63H 33/101 206/504 |
| 4,339,033 | A | 7/1982 | Cillario | |
| 4,509,930 | A * | 4/1985 | Schweigert | A63H 33/065 220/4.29 |
| 5,101,997 | A | 4/1992 | Bagwell et al. | |
| 5,115,916 | A | 5/1992 | Beasley et al. | |
| 5,259,524 | A | 11/1993 | Eckert | |
| 7,658,296 | B2 | 2/2010 | Van Handel et al. | |
| 2006/0210676 | A1 * | 9/2006 | Knebl | B65D 21/0204 426/106 |
| 2014/0004233 | A1 | 1/2014 | Ferry | |
| 2018/0057207 | A1 | 3/2018 | Maroofian et al. | |

OTHER PUBLICATIONS

Rekdal, Andreas, "This Techstars startup takes packed lunch off busy parents' plates," http://www.builtinchicago.org/2016/08/01/pakd-techstars-chicago-school-lunch-online, Aug. 2, 2016, in 5 pages.

Packaging World, vol. 24, No. 7, Jul. 2017, in 84 pages.

* cited by examiner

*Primary Examiner* — James N Smalley
*Assistant Examiner* — Elizabeth J Volz
(74) *Attorney, Agent, or Firm* — Michael R Shevlin

(57) ABSTRACT

Various modular container systems and methods are disclosed. The system can include one or more container modules configured to be pivotably or hingedly connected together. Food items can be placed in individual container modules separately and the container modules can be coupled together to form a portable interlocking unit and the container modules can be pivotably coupled with adjacent container modules.

20 Claims, 16 Drawing Sheets

MODULAR STORAGE SYSTEM

CROSS REFERENCE

This application claims the priority benefit under at least 35 U.S.C. § 119 of U.S. Patent Application No. 62/571,154, filed Oct. 11, 2017, entirety of which is hereby incorporated by reference herein.

BACKGROUND

Field

This disclosure relates to modular storage systems, such as modular food storage systems.

Certain Related Art

Food is packaged in various ways including within individual, closable containers. Closable containers allow for food to be packaged, stored, and transported in a manner that the food will not spill or comingle with other food undesirably. Types of closable containers include sealable containers and plastic clamshell packages.

SUMMARY OF CERTAIN FEATURES

The systems, methods, and devices described herein each have several aspects, no single one of which is solely responsible for its desirable attributes. Without limiting the scope of this invention as expressed by the claims which follow, some features are described briefly below.

The various systems and methods disclosed herein address certain challenges related to modular storage systems. In various embodiments, a modular food storage system is disclosed that includes one or more container modules. The container modules comprise can comprise various formats. For example, in some implementations, container modules comprise sealable containers, plastic clamshell packages, or packages comprising two separable pieces (e.g., in which a lid is not connected to a base and in which the lid is used to close an opening of the container). The container modules can be configured to be connected together, such as by a food processor (e.g., a company that processes, handles, and/or packages food). For example, the food processor can place food items in individual container modules separately and place the container modules in storage, such as in a refrigerator. In response to a request (e.g., an order from a grocery store, user or otherwise) for a certain mix of the food items, the food processor can mix and match the prefilled individual container modules. The food processor can assemble (e.g., connect) the container modules together for shipping, or can ship the container modules unassembled, which can be subsequently assembled by a seller (e.g., a grocery store) or by a user. The system can be used with many types of food items, such as cut fruit, various bakery items and flavors (e.g., cupcake varieties), hummus, salsa, salads, or other non-food items that require organization (e.g., hardware, nails, screws, nuts, or other). In some embodiments, the modular food storage system can be assembled by a consumer. For example, a parent can buy the unassembled container modules with food prepackaged inside, and can assemble a meal pack for a child. This can occur at home or at a retail store.

In various embodiments, the container modules are connected in such a way that the container modules are pivotably coupled with each other. This configuration can provide advantages in the storage, transportation and presentation of the modular storage system. For example, several container modules can be connected together in series, so that each of the container modules is pivotably coupled with at least one adjacent container module. The modular storage systems with pivotably connected container modules can be easily transported and stored by a user. For example, the modular storage systems can allow for a user to pick up an entire meal or portion of a meal. The pivotably connected container modules can allow for the modular storage system to be placed inside of another container (e.g., bag, box, basket or other) for storage or transportation.

As discussed in more detail below, in some variants, the series of container modules can be connected end-to-end together to form a portable interlocking unit. The portable interlocking unit can allow for compact storage and transportation of the modular storage system, such as within another container where space may be limited. The container modules of the portable interlocking unit can be formed to create certain shapes or profiles, such as circular, triangular, pentagonal, hexagonal, heptagonal, or octagonal shape or other. In some embodiments, the portable interlocking unit comprises a ring of container modules.

Various embodiments of modular storage systems are disclosed that include individual container modules that can be coupled together. A first container module can include a container wall that bounds a compartment for storage of an article (e.g., food items or other). The first container module can include an upper lip extending around an opening of the compartment of the container module. The upper lip of the first container module can include one or more connectors for coupling with adjacent container modules of the modular storage system. The adjacent container modules can be identical or similar to the first container module. The first container module of the modular container system can be coupled together with adjacent container modules to form a series of connected container modules. In some embodiments of the modular storage systems, the series can include two or more container modules, such as two, three, four, five, six, seven, eight, or more. Certain embodiments include a lower lip, such as a flange extending around a base of the module.

In some embodiments of the modular storage systems, the first container module can include one or more hinged connectors. In various embodiments, the hinged connector can comprise a living hinge (also called a flexure bearing). The first container module can include a first hinged connector that is hingedly connected with the upper lip of the container. In some embodiments, the first container module can include a second hinged connector. The second hinged connector can be hingedly coupled with the upper lip of the first container module. In some embodiments, the first hinged connector is on a first side of the container module and the second hinged connector is on an opposite side of the container module. The first hinged connector can be coupled with a second container module of the modular storage system. The second container module, in some cases, can be similar or identical to the first container module and having at least one hinged connector. Because of the hinged connectors, the first container module can be pivotal with respect to the second container module. In some embodiments, any number of container modules can be pivotably coupled together in this manner to form the series of connected container modules. For example, the at least one hinged connector of the second container can be pivotably coupled with a third container module of the modular storage system, and so on. In some embodiments, on at least one of the container modules, all of the connectors are hinged connectors.

In some embodiments, the container module can include first and second fixed connectors. The first and second fixed connectors can be on the upper lip of the container module. In some embodiments, the first fixed connector is on the first side of the container module with the first hinged connector. The second fixed connector can be on the opposite side of the container module with the second hinged connector. The second container module and any additional container modules can include at least one fixed connector. The first hinged connector of the container module can be coupled with the at least one fixed connector of the second container module to pivotably couple the first container module and the second container module. Similarly, the at least one hinged connector of the second container module can be coupled with a fixed connector on the third container module to pivotably couple the second and third container modules of the modular storage system.

In some implementations, the last container modules in the series of container modules that form the modular storage system can be coupled together. This can form a portable interlocking unit of container modules in a specific shape or profile. For example, the portable interlocking unit can be formed of four container modules coupled together in a shape, such as a square (e.g., a square profile on one end). In some embodiments of the modular storage systems, the container walls of the container modules include sidewalls. The sidewalls of the container modules can be adjacent to or in contact with the sidewalls adjacent container modules when the modular storage system is formed into the portable interlocking unit. For example, the sidewalls of each of the container modules can include first and second sidewalls that are set at a 120°, 90°, 72°, 60° or any other angle. In some embodiments, when four such container modules are coupled together into the portable interlocking unit, the container walls of each of the container modules can be adjacent to each other. In some embodiments, the cross-section of the portable interlocking unit can be a polygon shape (e.g., triangular, square or other) formed by the modular container shapes and determined by the angle of the sidewalls of each container module.

As mentioned above, in some embodiments, the portable interlocking unit can comprise a ring. The ring can be comprise a plurality of container modules coupled together to form a complete end-to-end chain or loop. The ring can be any shape, such as generally: circular, oval, rectangular, square, triangular, pentagonal, hexagonal, or otherwise. In some embodiments, the ring has facets that face radially outwardly and/or inwardly. The number of facets can be equal to the number of containers. In some embodiments of the ring, all of the upper lips of the container modules are on an outer periphery of the ring and the container walls are on an interior of the ring. In some embodiments, the container walls of the container modules are on the outer periphery of the ring and the upper lips are on the interior of the ring. The ring can allow for compact storage and transportation of the modular storage system. The ring can be formed around another article (e.g., a box, basket, tube, or other container), which can comprise a part of the portable interlocking unit. For example, the ring can surround a container with additional food items, eating utensils (e.g., napkins, plates, cups etc.), décor (e.g., flowers), or otherwise.

Details of one or more embodiments of the subject matter described in this application are set forth in the accompanying drawings and the description below. Any of the features, components, or details of any of the arrangements or embodiments disclosed in this application are combinable and modifiable to form new arrangements and embodiments that fall within the spirit and scope of this disclosure. Other features, aspects, and advantages will also become apparent from the description, drawings, and claims.

BRIEF DESCRIPTION OF THE DRAWINGS

Embodiments will now be described with reference to the following drawings, which are provided by way of example, and not limitation. Like reference numerals indicate identical or functionally similar elements.

DETAILED DESCRIPTION OF CERTAIN EMBODIMENTS

Figure 1:
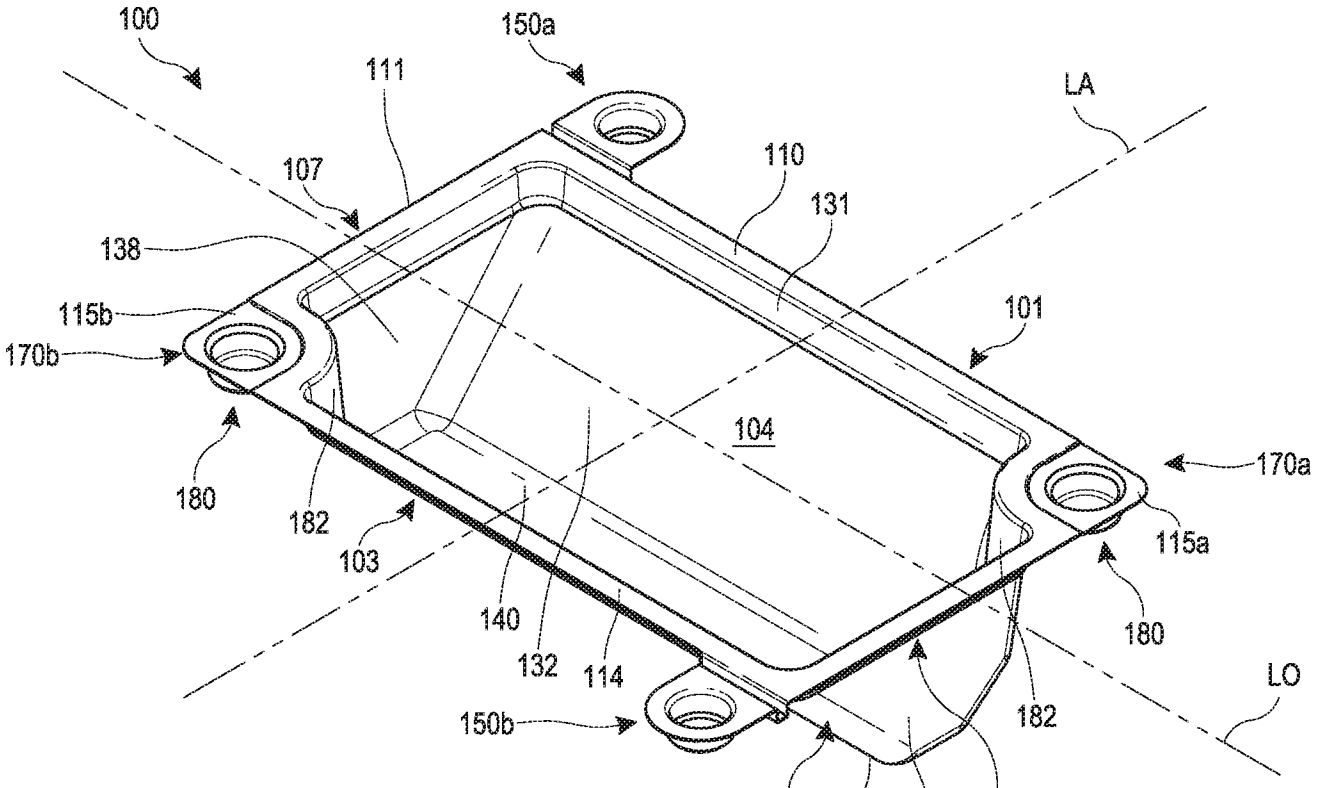
FIG. 1 is a front perspective view of an embodiment of a container module of a modular container system.

Various systems, methods, and components can be used in different embodiments of the invention. Some embodiments are illustrated in the accompanying figures; however, the figures are provided for convenience of illustration only, and should not be interpreted to limit the invention to the particular combinations of features shown. Any feature, structure, material, step, or component of any embodiment described and/or illustrated in this specification can be used by itself, or with or instead of any other feature, structure, material, step, or component of any other embodiment described and/or illustrated in this specification. Nothing in this specification is essential or indispensable.

Overview

Various modular container systems and methods are described below. In some embodiments, the modular container system includes a plurality of container modules. The container modules can be connected together to form a portable unit. The container module can include a compartment for the storage of items. For example, the compartment can be used to store food items, such as nuts, cut or whole fruits, vegetables, sandwiches, dips, crackers, etc. In some implementations, the compartment is configured to contain a liquid, such as soup. In some embodiments, the compartment houses non-food items, such as hardware (e.g., nuts, bolts, screws, washers, etc.), office supplies (e.g., paper clips, staples, etc.), or otherwise. The compartment can be closable, such as with a lid or polymer sheet. This can facilitate storage, organization, display and/or transportation of the small items more convenient for a user.

In various embodiments, two or more of the container modules can be connected and/or linked together, such as in a chain or series. In some embodiments, the container modules included in the series can be mixed and matched by a user based on the contents of the individual container modules. For example, the user can assemble a meal according to his or her preference by selecting container modules that contain various types of desired food items. The selected container modules can then be coupled together. In some embodiments, the modular food storage system can be assembled by a consumer. For example, a parent can buy the unassembled container modules with food prepackaged inside, and can assemble a meal pack for a child. This can occur at home or at a retail store.

The container module can include one or more connectors that facilitate coupling of adjacent container modules in the series. The connector can comprise, for example, a snap button connector, tab and slot, interlocking male and female connectors, or otherwise. In some variants, one or more of the connectors comprises a hinged connector, which can move (e.g., rotate) relative to the compartment. In some embodiments, one or more of the connectors comprises a fixed connector, which remains generally stationary relative to the compartment. In some implementations, the hinged connector of one container module can be coupled (e.g., snap-fit) with the fixed connector of an adjacent container module. In some embodiments, the container modules can be coupled together to form the series by coupling the hinged connectors and fixed connectors of each adjacent container modules in a chain-like manner.

In various embodiments, the series of individual container modules can be formed (e.g., by a user) into a portable interlocking unit by connecting first and final container modules of the connected series of container modules. In some embodiments, the portable interlocking unit can comprise a ring. Forming the portable interlocking unit can be facilitated by the hinged connectors of the container modules that enable adjacent container modules to be pivotably coupled together. In some embodiments, openings of the compartments of the container modules in the portable interlocking units can be faced radially outwardly or radially inwardly. In some embodiments, the facing of the openings of the container modules in the series can be mixed or varied, such as with some openings facing radially inwardly and other openings facing radially outwardly. In various embodiments, the container modules of the portable interlocking unit are not coupled with every other container module in the portable interlocking unit. For example, a given container module may only be connected to circumferentially adjacent container modules.

When formed into a portable interlocking unit, the container walls of the container modules can contact sidewalls of adjacent container modules. This arrangement can provide stability to the portable interlocking unit and/or can inhibit the container modules from moving relative to each other. In some embodiments, the portable interlocking unit of container modules can form specific shapes. For example, when viewed from an end of the portable interlocking unit, the shape of the portable interlocking unit can be generally: square, triangular, quadrangular, circular, oval, triangular, pentagonal, hexagonal, heptagonal, octagonal shape, or other. The shape can be formed by the number of container modules and/or by the peripheral container walls of the container modules in the portable interlocking unit. In various embodiments, the user can assembly a meal according to his or her preference by selecting a specific number of container modules that can then be formed into a portable interlocking unit with a specific shape. The selected container modules can then be coupled together by the user.

In some embodiments, the ring can be formed around another object. For example, the ring can encircle or otherwise surround a central container or hub, which can include a chamber. This can provide for storage of additional items, such as food items. For example, the chamber of the central module can contain a dip (e.g., salad dressing) and the container modules surrounding the central module can include vegetables for dipping into the dip. In some embodiments, the central module comprises a thermal material. For example, the central module can include ice or another cooling material, which can aid in cooling the container modules. In some variants, the central module comprises a heated material, such as hot water, which can aid in heating the container modules. In some variants, the central module can provide space for fluid (e.g., in refrigerated air) to access radially inner surfaces of the container modules. In certain implementations, the central container is tubular (e.g., generally cylindrical), though many other shapes are contemplated as well.

Container Module

FIGS. 1-5 illustrate an embodiment of a container module 100 of a modular storage system. The modular storage system can include any number of container modules, each configured to be pivotably coupled with an adjacent container module. As shown, the container module 100 can have a longitudinal axis LO and a lateral axis LA. The container modules comprise can comprise various formats. For example, in some implementations, container modules comprise sealable containers, plastic clamshell packages, or packages comprising two separable pieces (e.g., in which a lid is not connected to a base and in which the lid is used to close an opening of the container).

The container module 100 can include an upper lip 110, a container wall 130 and a compartment 104. The container wall 130 can at least partially bound the compartment 104. The compartment 104 can be enclosed on all lower sides by the container wall 130 and an opening can be provided on an upper side of the compartment 104. The container module 100 can be made out of a single piece of molded polymer or plastic. For example, the container wall 130 can be made entirely out of a single piece of polyethylene, polypropylene, or other suitable plastic for food storage. Food or other items can be placed within the compartment 104 for storage. In some embodiments, the container module 100 has multiple compartments 104, such as two, three, four, five, six, or more compartments.

In some embodiments, the upper lip 110 bounds the periphery of the opening of the compartment 104. The upper lip 110 can be configured such that a lid can be coupled with the upper lip 110 to enclose the compartment 104, such as to retain the food or other items within the compartment 104. For example, a thin polymer sheet can be placed over the opening of the compartment 104 and glued, heat sealed, or otherwise affixed to the upper lip 110. In some embodiments, a lid (not shown) can be removably fitted with the upper lip 110.

The upper lip 110 can be coupled with the container wall 130. In some embodiments, the upper lip 110 comprises a flat region or upper surface 114. The upper surface 114 can be configured to be connected with the lid or thin polymer sheet. In some embodiments, the upper lip 110 comprises an outer edge 111 that extends outwardly from and/or overhangs the container wall 130. The outer edge 111 can overhang the container wall 130 all the way around the opening of the compartment 104. In some embodiments, the upper surface 114 of the upper lip 110 is flat. In some embodiments, the upper surface 114 comprises a lower lip portion and a raised lip portion (not shown). In some embodiments, the raised lip portion is located inwardly of the lower lip portion, extends all the way around the opening of the compartment 104 and is configured to be connected with the lid. In some embodiments, the lower lip portion includes a plurality of connectors, as discussed below.

In some embodiments, when viewed from the top (FIG. 2) the container module 100 (e.g., the upper lip 110) forms a polygon shape. For example, the container module 100 can have a parallelogram or rectangular shape. In some embodiments, the container module 100 can have a square, triangular, quadrangular, circular, circular, triangular, pentagonal, hexagonal, heptagonal, or octagonal shape, etc.

The container module 100 can have first and second sides 101, 103. The first side 101 can be opposite the second side 103. In some embodiments, the first and second sides 101, 103 are generally parallel to each other. A first end 105 of the container module 100 can be opposite a second end 107 of the first container module 100. In some embodiments, the first and second ends 105, 107 are generally parallel to each other. In some implementations, the first side 101 and first end 105 can be at about 90° to each other. In certain variants, the second side 103 and the second end 107 can be at about 90° to each other. In some embodiments, the length of the first side 101 with respect to the first end 105 is approximately 2:1. In some embodiments, the ratio of the first side 101 to the first end 105 is between 1:1 and 4:1. In some embodiments, such as a triangular arrangement of the container module 100, the first and second sides 101, 103 can be at an angle between 0° and 180° to each other. For example, where the container module 100 is shaped as a right triangle, the first and second sides 101, 103 can be at 90° with respect to each other.

As mentioned above, the module 100 can include a container wall 130. The container wall 130 can be connected with the upper lip 110 at an upper portion 131 of the container wall 130. In some embodiments, the upper portion 131 is set at approximately 90 degrees with respect to the upper surface 114 of the upper lip 110. In some embodiments, the container wall 130 can comprise first and second sidewalls 132, 134. The first and second sidewalls 132, 134 can correspond to the first and second sides 101, 103 of the container module 100. The first sidewall 132 can be coupled with the upper portion 131 of the container wall 130. The upper portion 131 can be connected with the upper lip 110 through the upper portion 131 of the container wall 130. In some embodiments, the upper portion 131 is omitted. A lower end of both first and second side walls 132, 134 can be coupled with a bottom wall 140.

Figure 4:
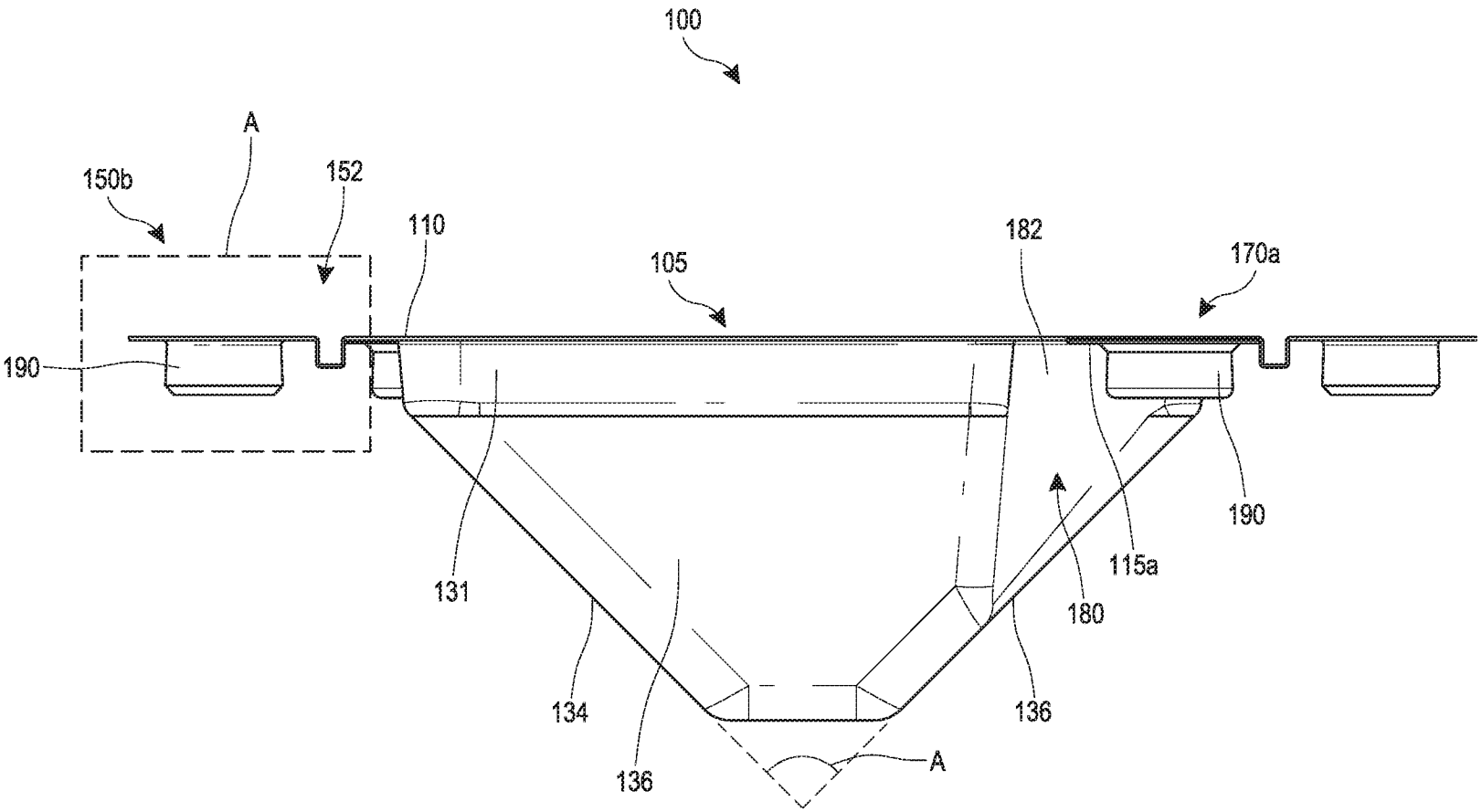
FIG. 4 is an end view of the container module of FIG. 1.

On the first end 105 of the container module 100, the first sidewall 132 and the second side wall 134 can be coupled with a first end wall 136. The first end wall 136 can extend between the first and second sidewalls 132, 134. The first end wall 136 can extend between the bottom wall 140 and the upper lip 110 or upper portion 131. On the second end 107 of the container module 100, the first sidewall 132 and the second side wall 134 can be coupled with a second end wall 138. The second end wall 138 can extend between the first and second sidewalls 132, 134. The second end wall 138 can be coupled with the bottom wall 140 on a lower side and with the upper lip 110 or the upper portion 131. In some embodiments, the first and second sidewalls 132, 134 can comprise generally flat and/or planar regions extending between the bottom wall 140 and the upper lip 110 (or upper portion 131) and/or between the first and second ends 105, 107 of the container module 100. As shown in FIG. 4, in some embodiments, the first sidewall 132 can be set at an angle A with the second side wall 134. For example, the angle A can be set at or approximately at any of 120°, 90°, 72°, or 60° angles or any other angle desired. As illustrated in FIG. 4, the angle A can be approximately 90°.

As shown in FIG. 1, the first and second end wall portions 136, 138 can extend between the sidewalls 132, 134 and the upper lip 110 (or upper portion 131) and the bottom wall 140. The end wall portions 136, 138 can be generally flat and/or planar. In some embodiments, the end walls 136, 138 are substantially parallel to each other. In some embodiments the first and second end walls 136, 138 are at a slight angle to each other, such as between about 0 and about 5 degrees. In some embodiments, the angle between the first and second end walls 136, 138 is greater than or equal to about 5 degrees.

Figure 3:
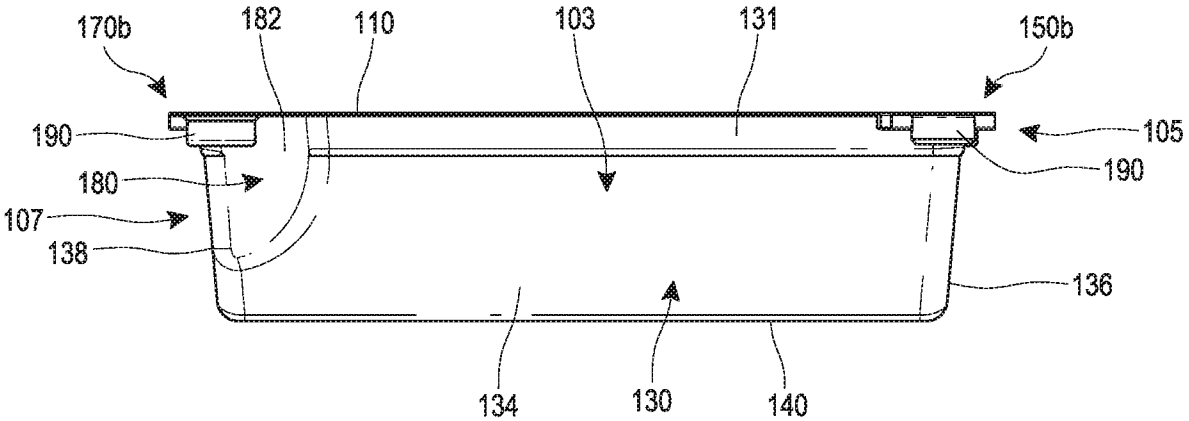
FIG. 3 is a side view of the container module of FIG. 1.

In some embodiments, the bottom wall 140 connects all of the first and second sidewalls 132, 134 and the first and second end walls 136, 138. In some embodiments, the bottom wall 140 forms a chamfer of the angle between the first and second sidewalls 132, 134. In some embodiments, the bottom wall 140 can be substantially parallel to the upper lip 110. In some embodiments, the bottom wall 140 allows for the container module 100 to be placed flat on a surface in an upright orientation, as shown in FIG. 3. In some embodiments, the bottom wall 140 is substantially centered within the container module 100 (e.g. centered with respect to the upper lip 110 and/or the container wall 130).

The container module 100 can comprise a fixed connector **170*a* and/or a second fixed connector 170*b*. In some embodiments, the fixed connectors 170*a*, 170*b* have the same structure. The fixed connector 170*a* can be on the upper lip 110. For example, the fixed connector 170*a* can be on an overhang portion 115*a* of the upper lip 110. The second fixed connector 170*b* can be on an overhang portion 115*b* of the upper lip 110. The overhang portion 115*a* can extend laterally and/or longitudinally outward from the container wall 130. In some embodiments, the overhang portion 115*a* and/or 115*b* can be lowered or offset from the upper surface 114 of the upper lip 110. This can facilitate aligning a connector coupled with the fixed connector 170*a* with the upper surface 114 of the upper lip 110. In some embodiments, the fixed connector 170*a* is approximately level with the upper surface 114. In some embodiments, the fixed connector 170***a* is on a portion of the upper lip 110 that is not overhanging outwardly from the container wall 130. For example, the portion may be overhanging inwardly on the upper lip 110 from the container wall 130.

The fixed connector 170*a* can be on a corner of the container module 100. For example, the fixed connector 170*a* can be at the corner between the first side 101 and the second end 105. The fixed connector 170*a* can include a connector 190. The connector 190 can comprise a male or female button, such as a circular bottom. In some embodiments, the connector 190 can comprise a snap lock, such a pin and recess with an interference fit or a hollow protrusion. The hollow protrusion can be closed on at least one end and/or does not comprise a through hole. In certain embodiments, the hollow protrusion of one of the connector 190 of the fixed connector 170*a* is configured to receive the protrusion of another corresponding connector, such as with a friction fit. In some embodiments, the connector 190 can include a hole, and the corresponding connector can include a mating protrusion configured to pass through the hole. In some embodiments, one or more connectors 190 can pass through two overlapping holes via a snap-fit, friction fit, or any other type of connection. In some embodiments, the connector 190 can be magnetic and magnetically coupled with the corresponding connector. In some embodiments, the fixed connector 170*a* is generally at the same angle as the lip 110. In some variants, the fixed connector 170*a* is at an angle with respect to the lip 110, such as less than or equal to about: 5°, 15°, 25°, 35°, 45°, 60°, angles between the aforementioned angles, and other angles. Some implementations include fixed connectors and not hinged connectors and/or the fixed connectors are configured (e.g., angled) to enable the circumferentially adjacent containers to connect together.

Figure 2:
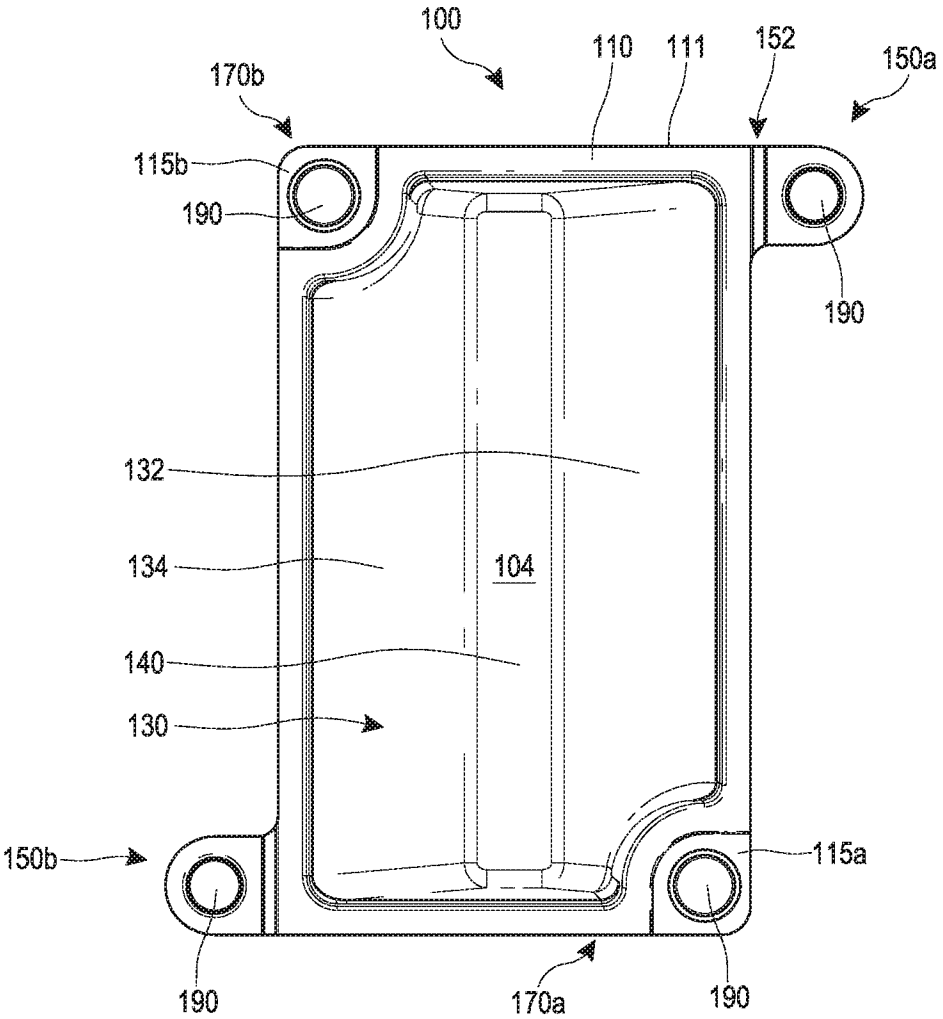
FIG. 2 is a top view of the container module of FIG. 1.

As shown in FIG. 2, a hinged connector 150*a* can be coupled with the upper lip 110. The hinged connector 150*a* can be configured to move (e.g., rotate) with respect to lip 110. In some embodiments, the container module 100 can include a second hinged connector 150*b*. The second hinged connector 150*b* can be similar or identical in structure to the hinged connector 150*a*. The hinged connector 150*a* can be configured to be coupled with a corresponding fixed connector, similar to fixed connectors 170*a*, 170*b*, on a second or adjacent container module 200, as described further below in reference to FIGS. 6-10. In some embodiments, the hinged connector 150*a* is on a longitudinally opposite end of the upper lip 110 from the fixed connector 170*a*. For example, the fixed connector 170*a* can be on the first end 105 of the container module 100 and the hinged connector 150*a* can be on the second end 107 of the container module 100. The hinged connector 150*a* can be on a corner of the upper lip 110 between the first side 101 and the second end 107 of the container module 100. The fixed connector 170*a* can be on a corner of the upper lip 110 between the first side 101 and the first end 105 of the container module 100. In another embodiment, the fixed connector 170*a* and/or the hinged connector 150*a* can be located on the first side 101 anywhere between the first and second ends 105, 107.

As shown in FIGS. 1, 3 and 4, the modular container 100 can include an access space 180. In some embodiments, one or both of the fixed connectors 170*a*, 170*b* can have an associated access space 180. For example, the access space 180 can be adjacent (e.g., beneath) the second fixed connector 170*b* and/or adjacent (e.g., beneath) the fixed connector 170*a*. The access space 180 can provide access to the connector 190 of the fixed connector 170*b*. For example, the access space 180 can provide access for a snap style connector. A user can reach into the access space 180 and pinch together the connector 190 with a corresponding connector of the adjacent container module. The access space 180 can be partially bounded by the overhang portion 115*a* of the upper lip 110. In some embodiments, the access space 180 can be bounded by a recess wall 182. The recess wall 182 can be between the second end wall 138 and the second sidewall 134. In some embodiments, the recess wall 182 comprises an arcuate or cylindrical surface. The recess wall 182 can provide structural integrity to the container wall 130 and/or can function as a reinforcing rib on the second sidewall 134 and second end wall 138.

The second hinged connector 150*b* and the second fixed connector 170*b* can be on the second side 103 of the container module 100. In some embodiments, the second fixed connector 150*b* is on an opposite end of the upper lip 110 from the second fixed connector 170*b*. For example, the second hinged connector 150*b* can be on the first end 105 of the container module 100 and the second fixed connector 170*b* can be on the second end 107 of the container module 100. The second hinged connector 150*b* can be on a corner of the upper lip 110 between the second side 103 and the first end 105 of the container module 100. The second fixed connector 170*b* can be on a corner of the upper lip 110 between the second side 103 and the second end 107 of the container module 100. In another embodiment, the second fixed connector 170*b* and/or the second hinged connector 150*b* can be located on the second side 103 anywhere between the first and second ends 105, 107. In some embodiments, the fixed connector 170*a* can be opposite the second hinged connector 150*b* on the first end 105 and the hinged connector 150*a* can be opposite the second fixed connector 170*b* on the second side 107.

In certain embodiments of the container module 100, the hinged connector 150*a* and second hinged connector 150*b* can be on the first side 101 and the fixed connector 170*a* and the second fixed connector 170*b* can be on the second side 103. For example, the hinged connectors 150*a*, 150*b* can be on the corners of the first side 101 and the fixed connectors 170*a*, 170*b* can be on the corners of the second side 103. This arrangement of the fixed and hinged connectors 150, 170 can enable the hinged connectors 150*a*, 150*b* to be coupled with corresponding fixed connectors 170*a*, 170*b* of an adjacent container module.

Figure 5:
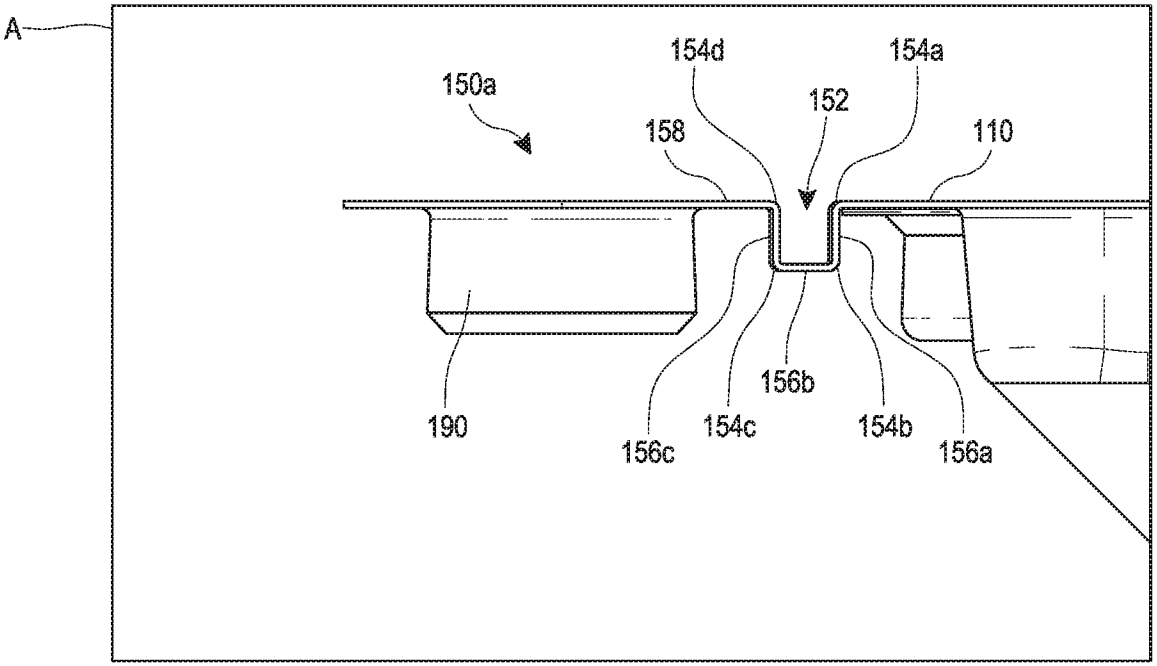
FIG. 5 is a detailed view of FIG. 4.

A detailed view of the hinged connector 150*a* is shown in FIG. 5. As illustrated, the hinged connector 150*a* can be hingedly coupled with the upper lip 110 at a hinge portion 152. The hinge portion 152 can comprise a first living hinge 154*a*. The living hinge 154*a* can couple the upper lip 110 with a first hinge panel 156*a*. The first hinge panel 156*a* can be coupled with a second hinge panel 156*b* by a second living hinge 154*b*. The second hinge panel 156*b* can be coupled with a third hinge panel 156*c* at a third living hinge 154*c*. The third hinge panel 156*c* can be coupled with a connector portion 158 of the hinged connector 150*a* at a fourth living hinge 154*d*. This configuration allows for substantial movement of the hinged connector 150*a* with respect to the upper lip 110. In some embodiments, the living hinges 154*a*-154*d* can be made from the same material as the upper lip 110 and/or the connector portion 158. In some embodiments, the living hinges can comprise scored, thinned or cut segments that allow the rigid material of the container module 100 to bend along the hinge. In some embodiments, the living hinges can formed during an injection, vacuum, or blow molding process (or similar process) forming the container module 100.

By having multiple living hinges 154*a*-154*d* and multiple hinge panels 156*a*-156*b* each individual panel and living hinge can undergo less pivoting (compared to some instances with just a single hinge) whereby the life of the overall hinge portion 152 can be lengthened and/or less material can be required to make the hinge portion 152. In some embodiments, the hinge portion 152 can be pivoted to 90, 120 or 180 degrees about the hinge portion 152.

In some embodiments of the hinge portion 152, a single living hinge connects the upper lip 110 and the connector portion 158 of the hinged connector 150*a*. In some embodiments, a single hinge panel connects two living hinges and the connector portion 158 with the upper lip 110. In some embodiments, the hinge portion 152 includes two hinge panels and three living hinges connecting between the upper lip 110 and the connector portion 158. In some embodiments, the container module includes tamper evident features, such as any of the features disclosed in U.S. patent application Ser. No. 16/151,660, filed Oct. 4, 2018, the entirety of which is hereby incorporated by reference herein.

Modular Storage Systems

Figure 6:
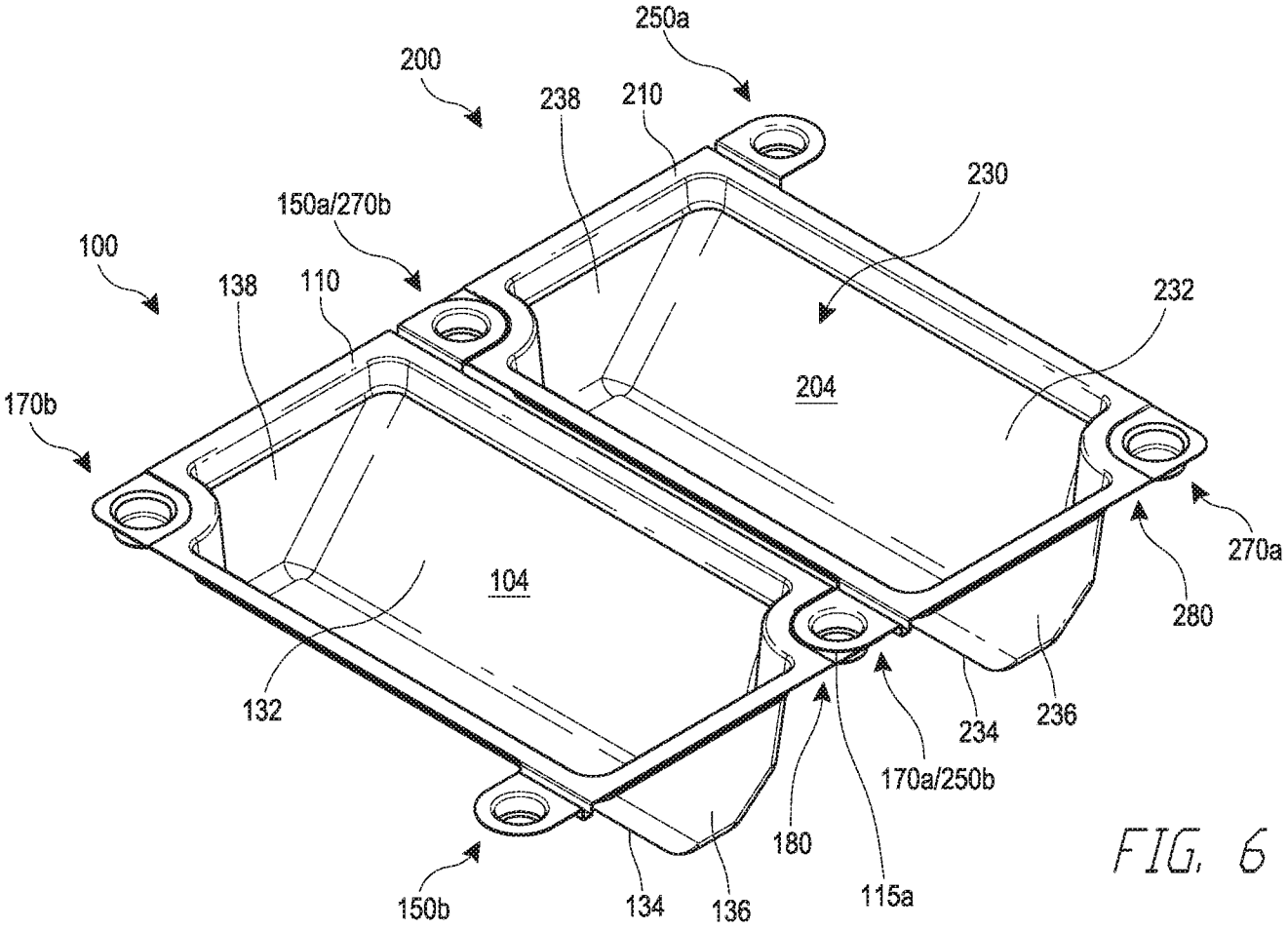
FIG. 6 shows an assembly of two container modules as shown in FIG. 1 coupled together.
Figure 7:
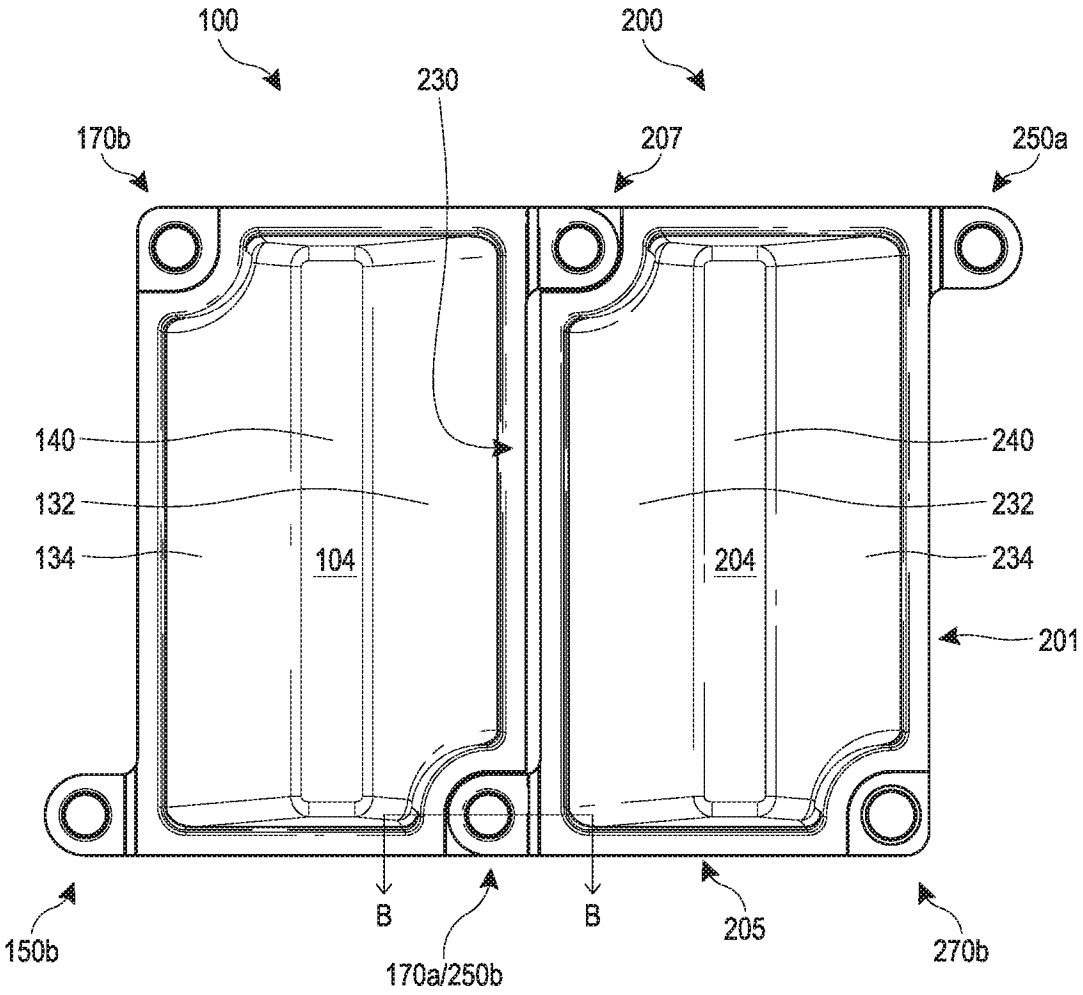
FIG. 7 is a top view of the assembly of FIG. 6.
Figure 8:
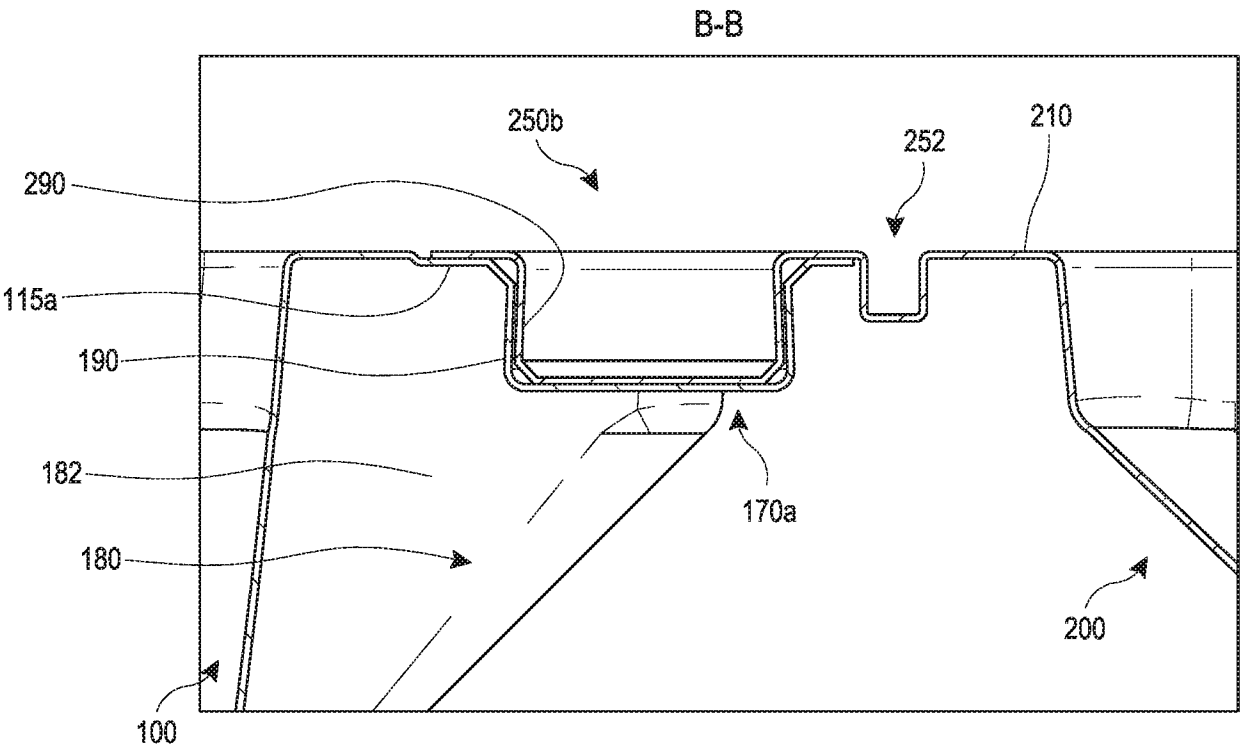
FIG. 8 is a section view taken along the line 8-8 in FIG. 7.

FIGS. 6-8 illustrate an example of how the container module 100 can be pivotably coupled with a second or adjacent container module 200. In some embodiments, the second container module 200 can be similar or identical to the first container module 100. The second connector 200 can include a compartment 204, an upper lip 210, a container wall 230, hinged connectors 250*a*, 250*b*, fixed connectors 270*a*, 270*b*, and an access space 280. The container wall 230 can include first and second sidewalls 232, 234 and first and second end walls 236, 238 and a bottom wall 240. The second container module can include a first end 205, a first side 201, a second side 203 and a second end 207. The fixed connector 270*b* can be on the upper lip 210 on the second side 203 of the container module 200. The hinged connector 250*b* can be pivotably coupled with the upper lip 210 on the second side 203. The hinged connector 150*a* can be coupled with the fixed connector 270*b*. The hinged connector 250*b* can be coupled with the fixed connector 170*a* and thereby the container module 100 can be pivotably coupled with the container module 200.

As illustrated in FIG. 8, the fixed connector 170*a* can include a connector 190 and the hinged connector 250*b* can include a connector 290. The connectors 190, 290 can be coupled together by a friction fit. For example, an outer and/or lower surface of the connector 290 can be fit within a cavity of the connector 190 of the first fixed connector 170*a* of the container module 100. In some embodiments, the connector 190 is fit within a cavity of the connector 290. This connector coupling arrangement can be used in any of the fixed or hinged couplers described herein.

Figure 9:
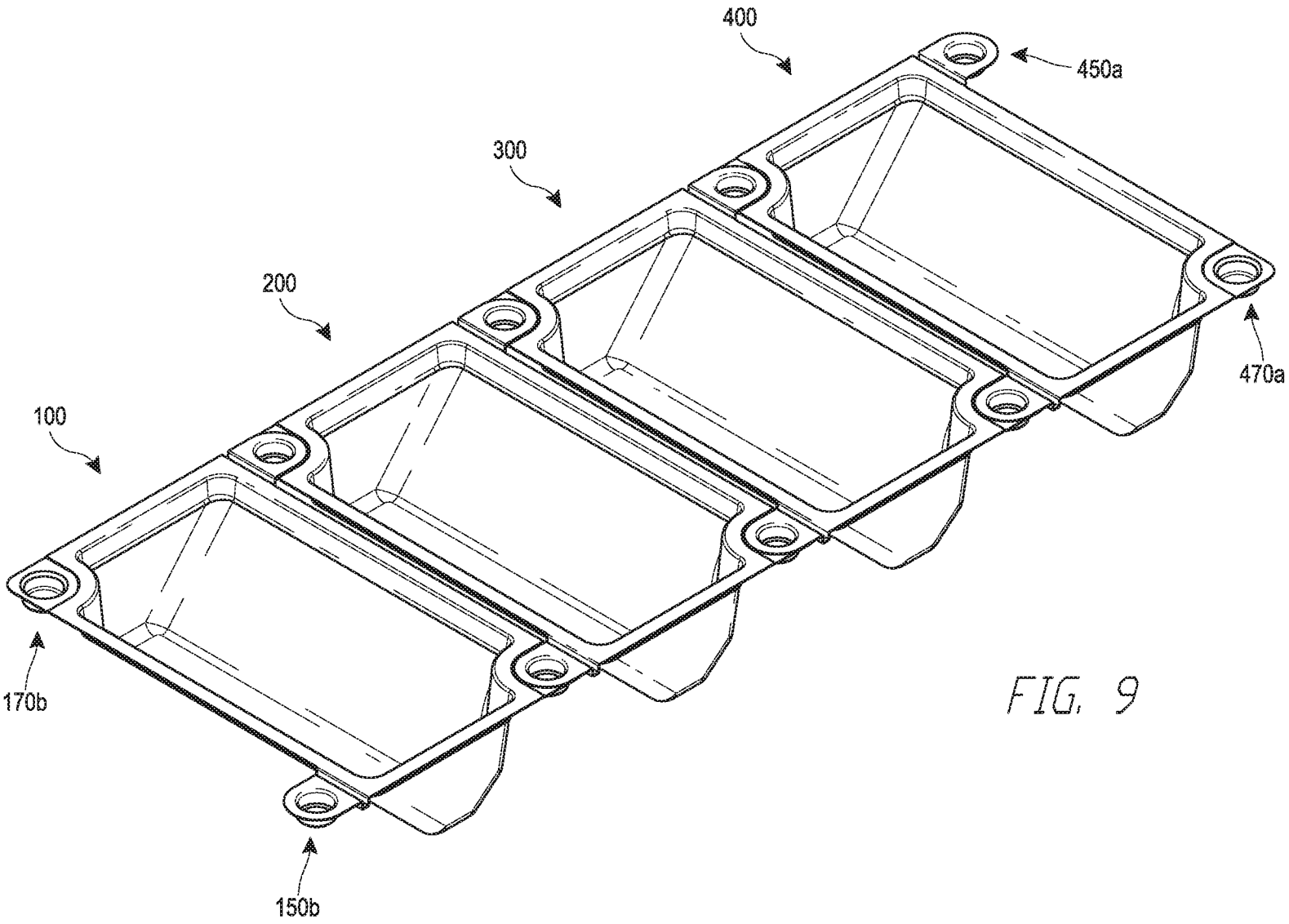
FIG. 9 is an assembly view showing four container modules as shown in FIG. 1 coupled together in series.

As illustrated in FIG. 9, in some embodiments, third, fourth (or more) container modules 300, 400 can be coupled in sequence to form a series. The third and fourth container modules can have the same structure as the first and second container modules 100, 200. Fixed and/or hinged connectors of the first container module 100 can pivotably couple with fixed and/or hinged connectors of the second container module 200. Fixed and/or hinged connectors of the second container module 200 can pivotably couple with fixed and/or hinged connectors of the third container module 300. Fixed and/or hinged connectors of the third container module 300 can pivotably couple with fixed and/or hinged connectors of the fourth container module 400.

Figure 10:
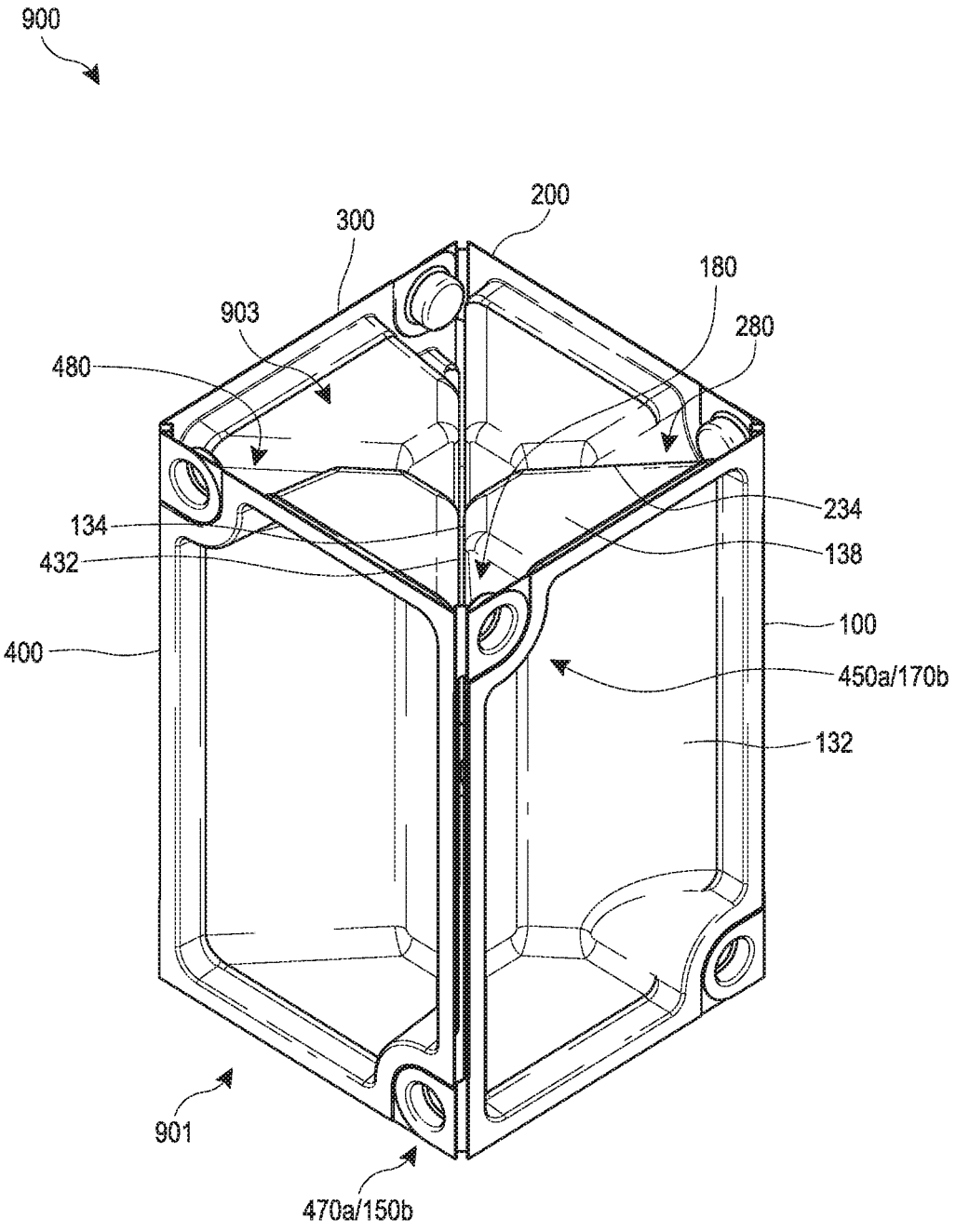
FIG. 10 is a perspective view of the four container modules of FIG. 9 coupled together to form a portable interlocking unit.

In some embodiments, the final container module of the series can be coupled with the first container module of the series. This can form a portable interlocking unit, as shown in FIG. 10. For example, fixed and/or hinged connectors 450*a*, 470*a* of the fourth container module 400 can be connected with fixed and/or hinged connectors 170*b*, 150*b* of the first container module 100 to form a portable interlocking unit 900. The portable interlocking unit 900 can have various shapes and embodiments for ease of transport, carrying, and/or displaying. The portable interlocking unit 900 can include container modules that the user can select according to a desired order or preferences. For example, each container module can be selected by a user for its foods content, shape, and/or dimensions and be coupled together to form the portable interlocking unit 900.

The portable interlocking unit 900 can include container modules 100, 200, 300, 400 formed into a shaped portable interlocking unit. The number and/or shape of container modules in the series can be selected to form the shape of the portable interlocking unit. For example, the portable interlocking unit 900 can include four container modules, as illustrated in FIG. 10 and can be formed into a quadrangular portable interlocking unit or generally square shaped portable interlocking unit (e.g., when viewed from an end). The portable interlocking unit 900 has a first end 901 and second end 902. In some embodiments, the first or second ends 901, 902 can have a profile of a rectangle or a square. In some embodiments, the portable interlocking units has end portions that can have triangular, pentagonal, hexagonal or other shapes, as discussed below in FIGS. 11-13.

In some embodiments of the portable interlocking unit 900, the container walls can be in contact with and/or adjacent to the container walls of adjacent container modules. The sidewalls of the container modules of the series can be adjacent to or in contact with the sidewalls of adjacent container modules when the modular storage system is formed into the portable interlocking unit 900. For example, the sidewall 132 of the container module 100 can be adjacent to and/or in contact with the sidewall 234 of the second container module 200. The sidewall 134 of the container module 100 can be adjacent to and/or in contact with a sidewall 432 of the fourth container module 400. This can be continued for all of the container modules of the portable interlocking unit 900. By selecting the angle of the first and second sidewalls (e.g., angle A between sidewalls 132, 134) of each of the container modules, the shape of the portable interlocking unit 900 can be designed. For example, the angle A for each of the container modules 100-400 can be set at approximately a 90° angle to form a portable interlocking unit 900 with a square cross-sectional profile.

In some embodiments, the formation of the portable interlocking unit 900 can form boundaries for the access space 180. For example, the sidewall 432 of the fourth container module 400 can be adjacent to the second sidewall 134 of the first container module 100. A portion of the sidewall 432 can at least partially bound and/or enclose the access space 180. In some embodiments, the access space 180 (and any additional access spaces; e.g., 280, 380, 480) can be accessible at one or both of the container ends 901, 902 of the portable interlocking unit 900. The access space 180 can provide access for a user's fingers to couple the connector 190 of the fixed connector 170*b* with the connector of the hinged connector 450*a* of the fourth container module 400. The access space 180 can thus provide access to the connectors 190 of the fixed and/or hinged connectors of the container modules of the portable interlocking unit 900 to connect the container modules thereof. This pattern can be continued for all of the container modules of the portable interlocking unit 900.

In some embodiments, the series can comprise a loop, such as a ring. The ring can be formed such that upper lips (e.g., 110, 210, etc.) of the container modules in the series are on an outer periphery of the ring and/or the container walls (e.g., 130, 230, etc.) can be on an interior of the ring. For example, the openings bounded by the upper lips can be faced radially outward relative to the ring. In some embodiments of the ring, the upper lips can be on the interior of the ring and/or the container walls can extend around the exterior of the ring. For example, the openings bounded by the upper lips can be faced radially inward relative to the ring.

In some embodiments, the container walls 130, 230 can be in contact with each other. This can provide strength and support and/or can make the portable interlocking unit more rigid. In some embodiments of the ring, the container walls 130, 230 can be angled, or otherwise configured, such that they are not in constant contact with each other. This can give the ring a more free-form structure and/or can provide space between the container, such as for cooling fluid (e.g., in refrigerated air).

In some embodiments, the ring can be formed around another object. For example, the ring can be formed around a central container or hub. The hub can contain another food. For example, the container modules in the ring can include vegetables for dipping in a dressing contained in the central module. In some embodiments, the ring of the container modules can be sized to fit within another box or basket. For example, the ring can be formed to fit inside of a container (e.g., box or picnic basket). Other food items can be placed within the ring and/or within the container.

In some embodiments, at least some of the container modules of the modular container system can include at least one dimension that is different from other container modules. For example, the container module 200 can include the first and second ends 205, 207 with a different length than a length of first and second ends 105, 107 of the container module 100. The first and second ends 205, 207 can be, as non-limiting examples, 1.5, 2, or 3 times the length of the first and second ends 105, 107. Thus, in some embodiments of the modular container system, the user can select from a set of connectable modular containers with different dimensions to form the series. In some embodiments, the adjacent container modules can be selected from a set of compatible container modules of a different shape (e.g., circular, triangular, or other) or at least one dimension (e.g., length, width, or other) than the first container module.

Figure 11A:
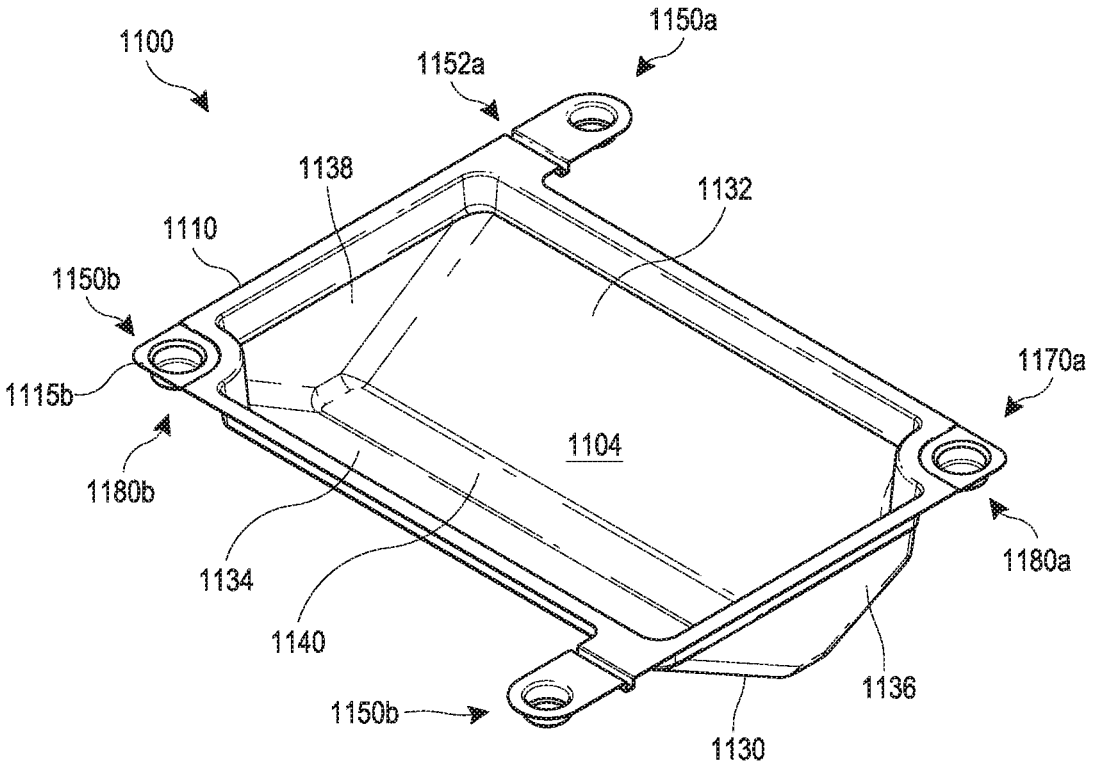
FIG. 11A is a front perspective view of another embodiment of a container module of a modular container system.
Figure 11B:
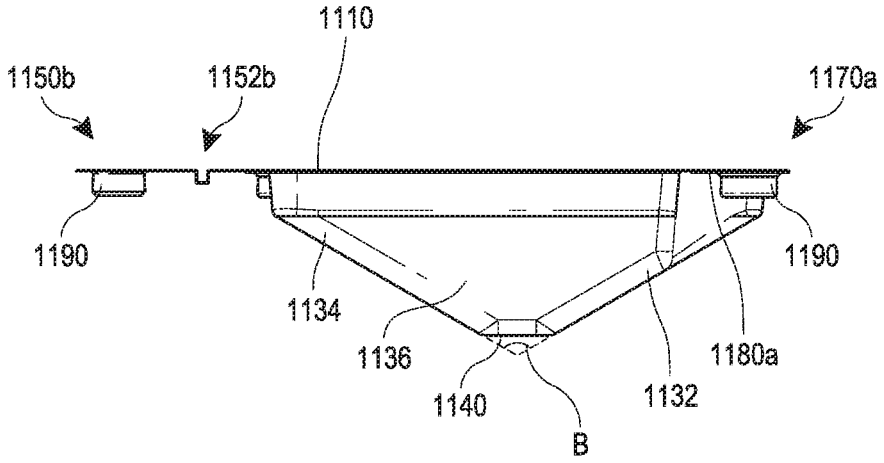
FIG. 11B is a side view of the container module of FIG. 11A.
Figure 11C:
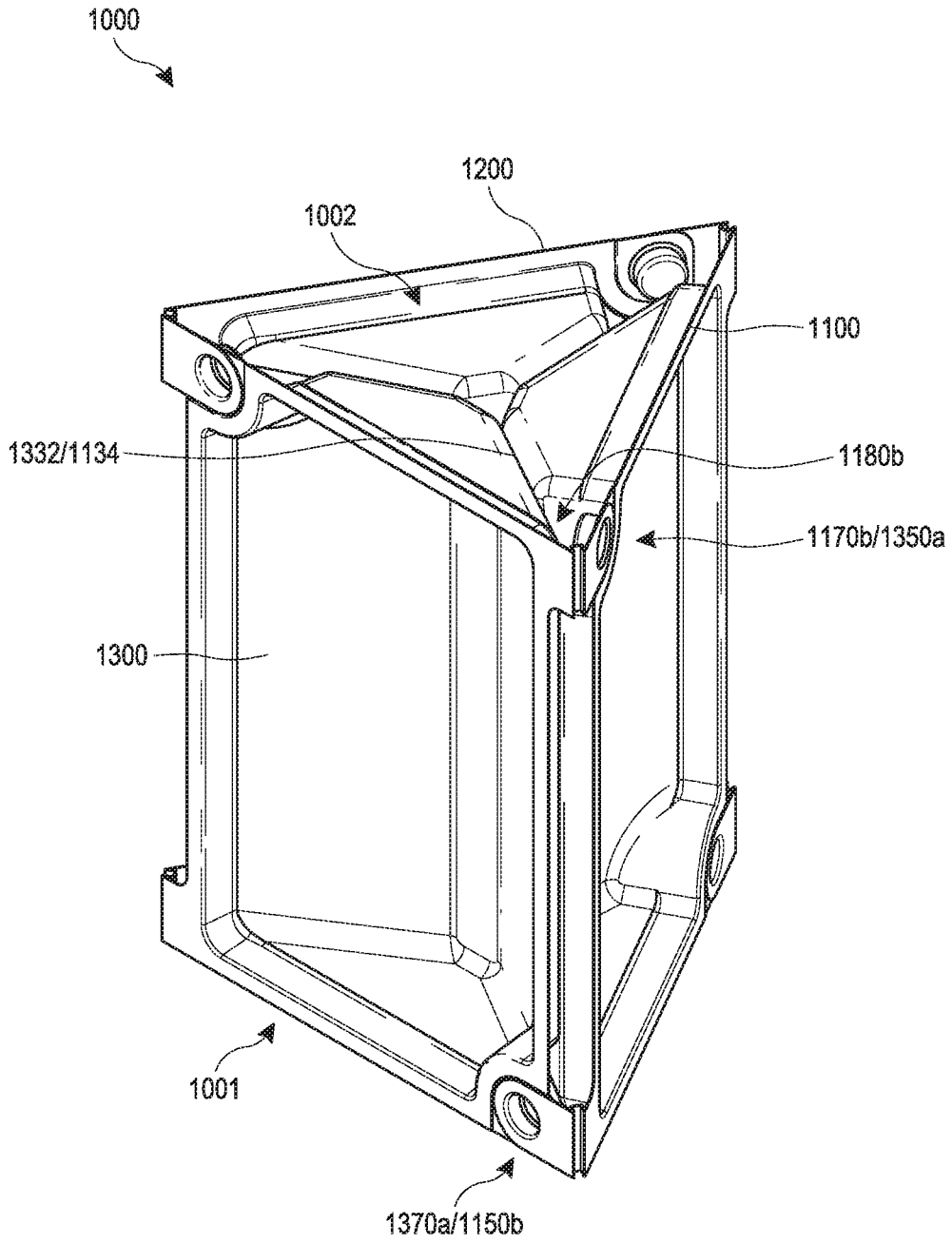
FIG. 11C is a perspective view of three container modules of FIG. 11A coupled together to form a triangular portable interlocking unit.

FIGS. 11A-11C illustrate another container module 1100. The container module 1100 can have any of the features of the container module 100. The container module 1100 can include an upper lip 1110 defining an opening of a compartment 1104. The compartment 1104 can be further bounded by a container wall 1130. The container wall 1130 can include first and second sidewalls 1132, 1134 and first and second end walls 1136, 1138. In some embodiments, the container wall 1130 can include a bottom wall 1140 coupled with the first and second sidewalls 1132, 1134 and the first and second end walls 1136, 1138. The first and second end walls 1132, 1134 can each comprise planar portions that are set at an angle B. As illustrated, the angle B is approximately 120°.

Figure 12A:
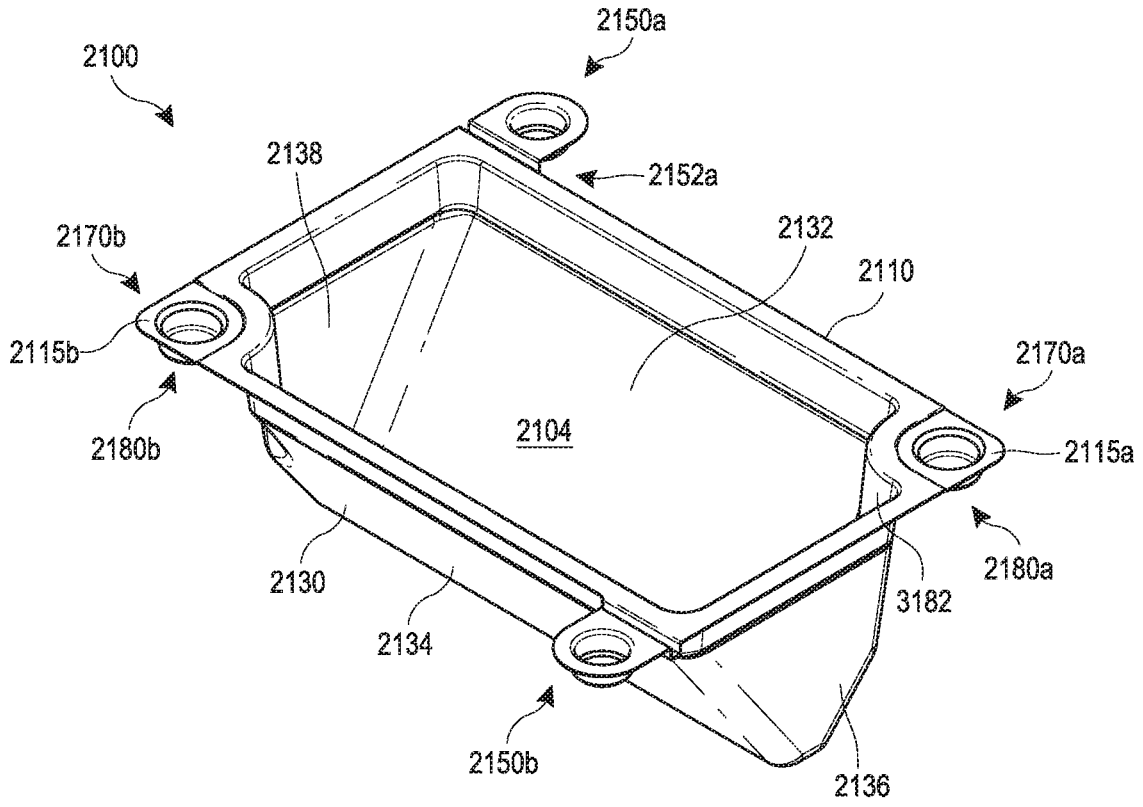
FIG. 12A is a front perspective view of another embodiment of a container module of a modular container system.
Figure 12B:
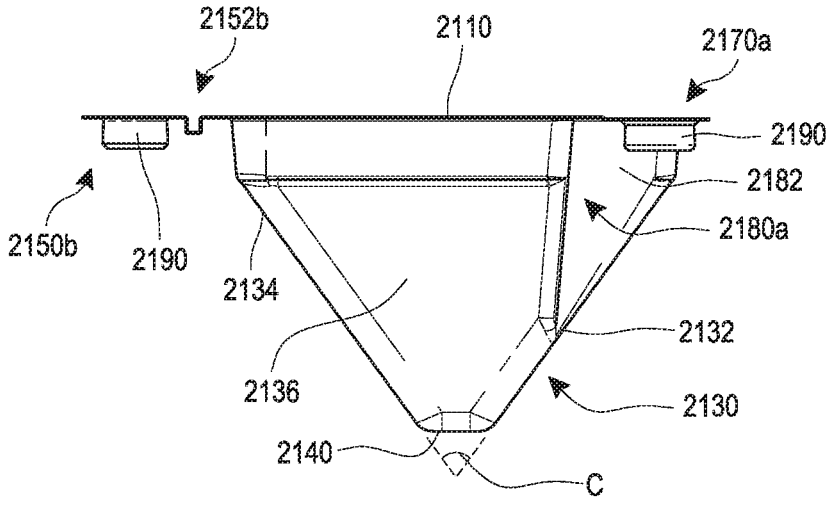
FIG. 12B is a side view of the container module of FIG. 12A.
Figure 12C:
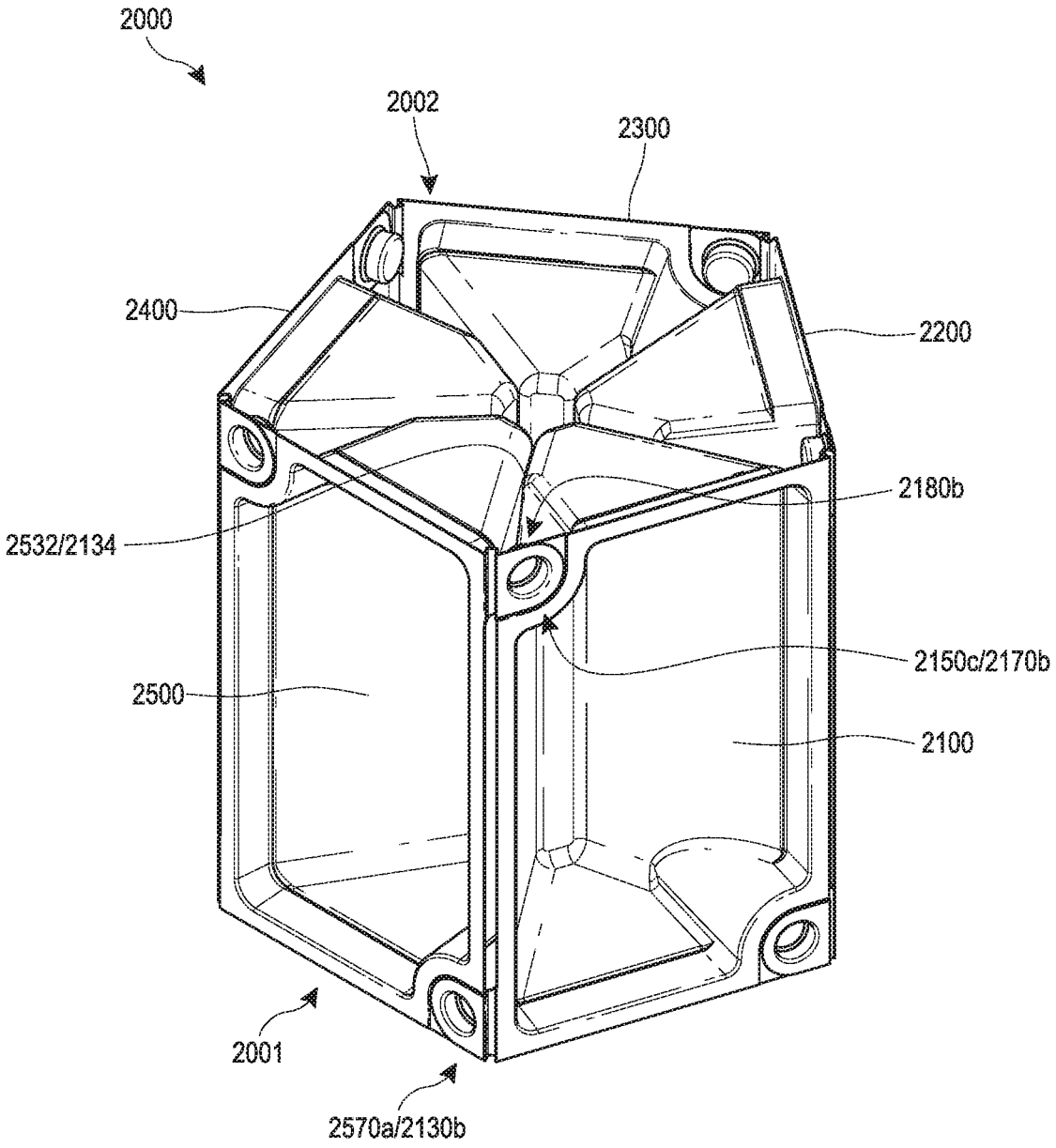
FIG. 12C is a perspective view of five container modules of FIG. 12A coupled together to form a pentagonal portable interlocking unit.

FIGS. 12A-12C illustrate another container module 2100. The container module 2100 can have any of the features of the container module 100. The container module 2100 can include an upper lip 2110 defining an opening of a compartment 2104. The compartment 2104 can be further bounded by a container wall 2130. The container wall 2130 can include first and second sidewalls 2132, 2134 and first and second end walls 2136, 2138. In some embodiments, the container wall 2130 can include a bottom wall 2140 coupled with the first and second sidewalls 2132, 2134 and the first and second end walls 2136, 2138. The first and second end walls 2132, 2134 can each comprise planar portions that are set at an angle C. As illustrated, the angle C is approximately 72°.

Figure 13A:
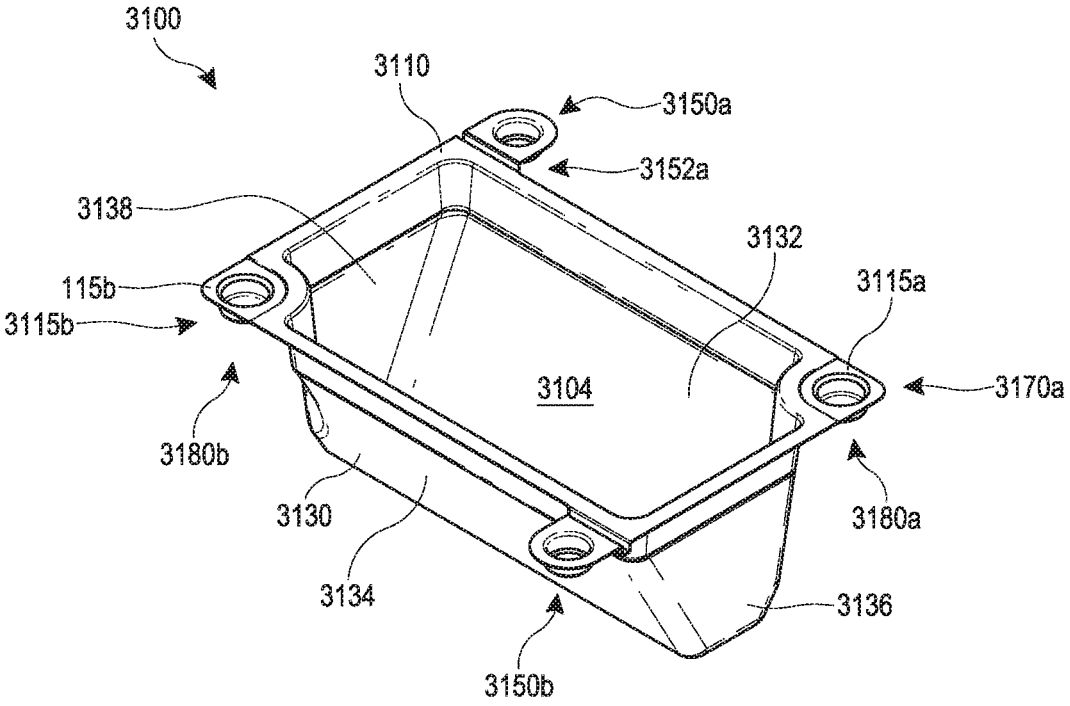
FIG. 13A is a front perspective view of another embodiment of a container module of a modular container system.
Figure 13B:
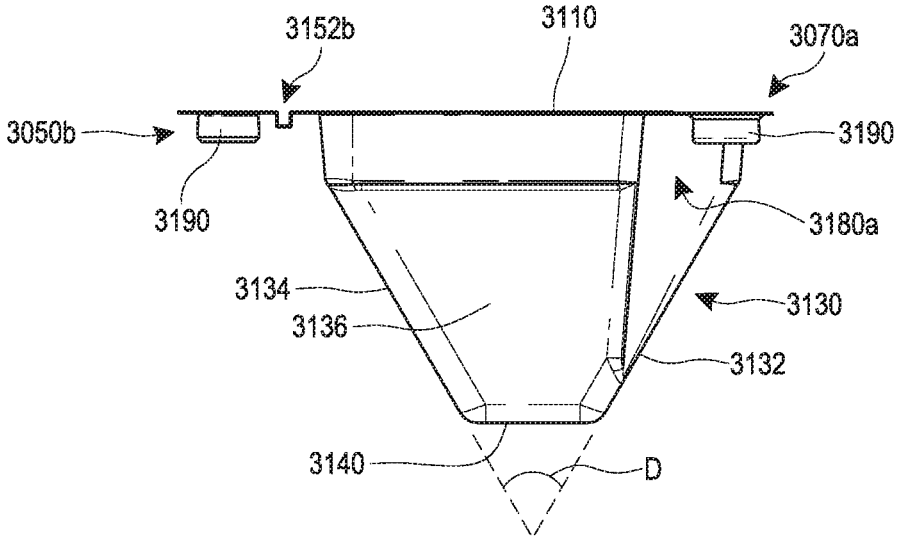
FIG. 13B is a side view of the container module of FIG. 13A.
Figure 13C:
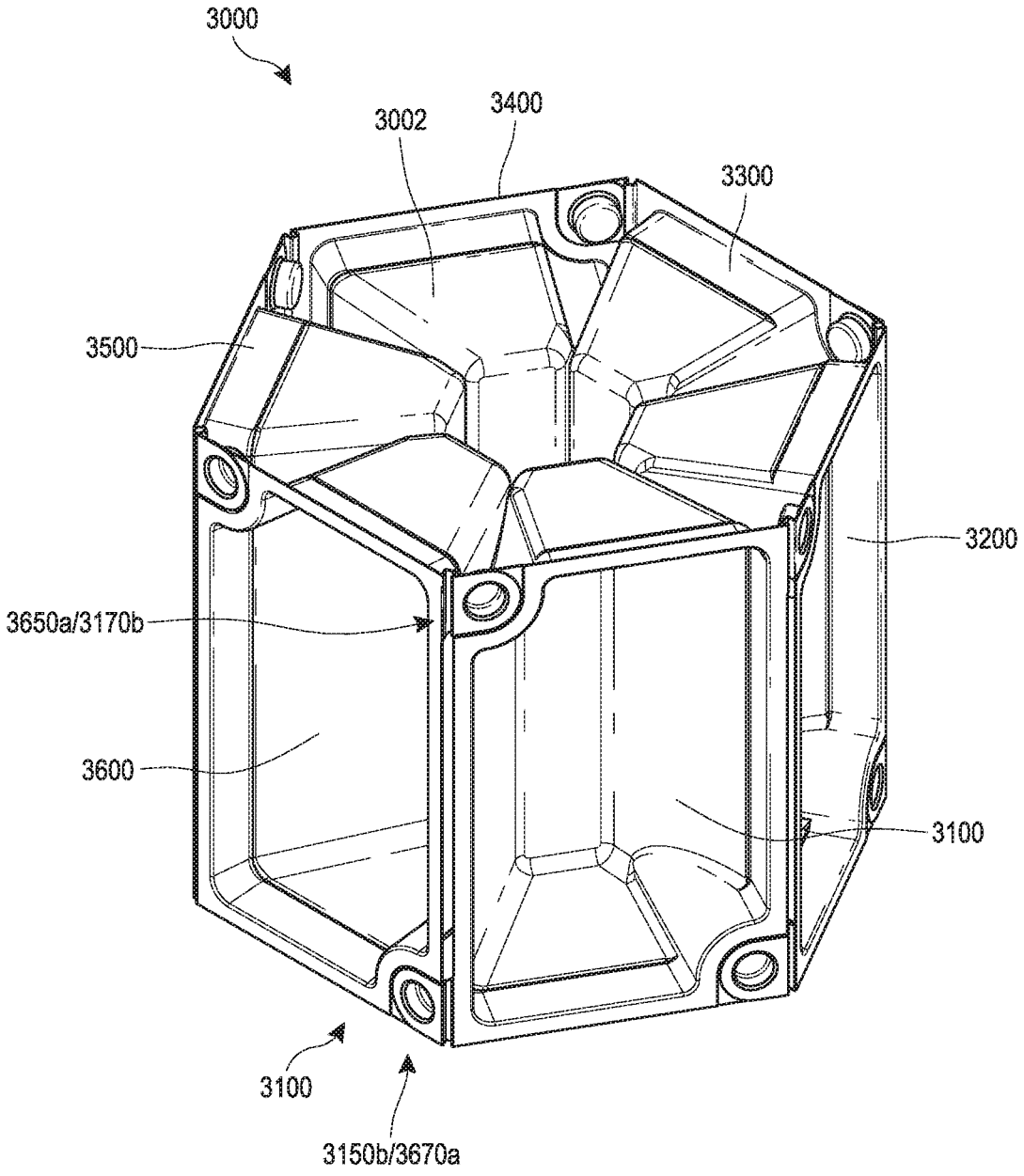
FIG. 13C is a perspective view of six container modules of FIG. 13A coupled together to form a hexagonal portable interlocking unit.

FIGS. 13A-13C illustrate another container module 3100. The container module 3100 can have any of the features of the container module 100. The container module 3100 can include an upper lip 3110 defining an opening of a compartment 3104. The compartment 3104 can be further bounded by a container wall 3130. The container wall 3130 can include first and second sidewalls 3132, 3134 and first and second end walls 3136, 3138. In some embodiments, the container wall 3130 can include a bottom wall 3140 coupled with the first and second sidewalls 3132, 3134 and the first and second end walls 3136, 3138. The first and second end walls 3132, 3134 can each comprise planar portions that are set at an angle C. As illustrated, the angle D is approximately 60°.

Certain Terminology

Terms of orientation used herein, such as "top," "bottom," "horizontal," "vertical," "longitudinal," "lateral," and "end" are used in the context of the illustrated embodiment. However, the present disclosure should not be limited to the illustrated orientation. Indeed, other orientations are possible and are within the scope of this disclosure. Terms relating to circular shapes as used herein, such as diameter or radius, should be understood not to require perfect circular structures, but rather should be applied to any suitable structure with a cross-sectional region that can be measured from side-to-side. Terms relating to shapes generally, such as "circular" or "cylindrical" or "semi-circular" or "semi-cylindrical" or any related or similar terms, are not required to conform strictly to the mathematical definitions of circles or cylinders or other structures, but can encompass structures that are reasonably close approximations.

Some embodiments have been described in connection with the accompanying drawings. The figures are drawn to scale where appropriate, but such scale should not be limiting, since dimensions and proportions other than what are shown are contemplated and are within the scope of the disclosed invention. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein. Additionally, any methods described herein may be practiced using any device suitable for performing the recited steps.

The terms "approximately," "about," and "substantially" as used herein represent an amount close to the stated amount that still performs a desired function or achieves a desired result. For example, in some embodiments, as the context may permit, the terms "approximately", "about", and "substantially" may refer to an amount that is within less than or equal to 10% of the stated amount. The term "generally" as used herein represents a value, amount, or characteristic that predominantly includes or tends toward a particular value, amount, or characteristic. As an example, in certain embodiments, as the context may permit, the term "generally parallel" can refer to something that departs from exactly parallel by less than or equal to 20 degrees.

SUMMARY

Although this invention has been disclosed in the context of certain embodiments and examples, the scope of this disclosure extends beyond the specifically disclosed embodiments to other alternative embodiments and/or uses of the invention and obvious modifications and equivalents thereof. For example, some embodiments of the modular container system described above have been disclosed in the context of food containers. Other possible applications of the modular container system can include storage of any small articles that require organization. For example, hardware components (e.g., nails, screws, nuts, etc.) can be organized and stored in the above-described modular container systems. Such an implementation can be used to create custom sets of commonly used components that correspond to various kits or projects. When individual types of commonly used components are stored in the container modules of the modular container system, the custom sets can be easily and quickly assembled to suit any need.

Any system, method, and device described in this application can include any combination of the preceding features described in this and other paragraphs, among other features and combinations described herein, including features and combinations described in subsequent paragraphs. While several variations of the invention have been shown and described in detail, other modifications, which are within the scope of this invention, will be readily apparent to those of skill in the art based upon this disclosure. It is also contemplated that various combinations or sub-combinations of the specific features and aspects of the embodiments may be made and still fall within the scope of the invention. Various features and aspects of the disclosed embodiments can be combined with, or substituted for, one another in order to form varying modes of the disclosed invention. Thus, it is intended that the scope of the present invention herein disclosed should not be limited by the particular disclosed embodiments described above, but should be determined only by a fair reading of the claims that follow.

The following is claimed:

1. A modular container system comprising:

a first container module comprising:

a first peripheral wall;

a first compartment for receiving a first article, the first compartment at least partially bound by the first peripheral wall;

a first opening configured to provide access to the first compartment;

an upper lip extending around the first opening;

a first hinged connector pivotally coupled with the upper lip at a hinge portion; and a first fixed connector; and a second container module comprising:

a second peripheral wall;

a second compartment for receiving a second article, the second compartment at least partially bound by the second peripheral wall;

a second opening configured to provide access to the second compartment;

an upper lip extending around the second opening;

a second hinged connector pivotally coupled with the upper lip at a hinge portion; and a second fixed connector;

wherein the hinge portion comprises:

a first living hinge coupled to the upper lip with a first hinge panel, the first hinge panel coupled with a second hinge panel by a second living hinge, the second hinge panel coupled with a third hinge panel at a third living hinge, the third hinge panel coupled with a connector portion of the hinged connector at a fourth living hinge; and wherein the first hinged connector is coupled with the second fixed connector and the first fixed connector is coupled with the second hinged connector, thereby attaching the first and second container modules.

2. The modular container system of claim 1, wherein the first fixed connector located within the upper lip.

3. The modular container system of claim 1, wherein the upper lip is generally rectangular and includes first and second sides and first and second ends.

4. The modular container system of claim 3, wherein first fixed connector and the first hinged connector are located on the first side of the upper lip.

5. The modular container system of claim 1, wherein the first hinged connector couples with the second fixed connector by a snap button.

6. The modular container system of claim 5, wherein the first module comprises an access space in the peripheral wall of the first module beneath the first fixed connector for facilitating access by a user to connect the first fixed connector with the second hinged connector.

7. The modular container system of claim 1, wherein:

the first peripheral wall comprises first and second sidewalls, the first sidewall fixed with respect to the second side at a first angle;

the second peripheral wall comprises first and second sidewalls, the first sidewall fixed with respect to the second side at a second angle; and the first and second angles are the same.

8. The modular container system of claim 7, wherein the first and second angles are one of 60°, 72°, 90°, and 120°.

9. The modular container system of claim 7, wherein the first peripheral wall further comprises a bottom panel forming a chamfer between the first and second sidewalls, the first module configured to rest on the bottom panel in an upright orientation.

10. The modular container system of claim 1, further comprising a third container module, the third container module comprising:

a third peripheral wall;

a third compartment for receiving a third article, the third compartment at least partially bound by the third peripheral wall;

a third opening configured to provide access to the third compartment;

an upper lip extending around the third opening coupled to the third peripheral wall;

a third hinged connector pivotally coupled with the upper lip at a hinge portion; and a third fixed connector, wherein the hinge portion comprises:

a first living hinge coupled to the upper lip with a first hinge panel, the first hinge panel coupled with a second hinge panel by a second living hinge, the second hinge panel coupled with a third hinge panel at a third living hinge, the third hinge panel coupled with a connector portion of the hinged connector at a fourth living hinge; and wherein the third hinged connector is coupled with a fourth fixed connector of the first module and the third fixed connector is coupled with a fourth hinged connector on the first module to attach the first and third container modules.

11. The modular container system of claim 10, wherein the second and third modules are attached to form a complete ring.

12. The modular container system of claim 10, further comprising a fourth container module attached with the second modules opposite the first module.

13. A modular container comprising:

a peripheral wall having first and second sidewalls;

a compartment for receiving a first article, the first compartment at least partially bound by the peripheral wall;

an upper lip at least partially surrounding a first opening configured to provide access into the first compartment; and a first fixed connector and a second fixed connector in the upper lip;

a first hinged connector and a second hinged connector pivotally coupled with the upper lip at a hinge portion, wherein the hinge portion comprises:

a first living hinge coupled to the upper lip with a first hinge panel, the first hinge panel coupled with a second hinge panel by a second living hinge, the second hinge panel coupled with a third hinge panel at a third living hinge, the third hinge panel coupled with a connector portion of the hinged connector at a fourth living hinge;

the first fixed and first hinged connectors located on a first side of the upper lip;

the second fixed and second hinged connectors located on a second side of the upper lip opposite the first side;

wherein the modular container is configured to attach with an identical modular container by the first fixed and first hinged connectors.

14. The modular container of claim 13, wherein the upper lip is generally rectangular.

15. The modular container of claim 13, wherein the first hinged connector comprises a snap button.

16. The modular container of claim 13, further comprising an access space in the peripheral wall beneath the first fixed connector for facilitating access by a user to connect the first fixed with a hinged connector.

17. The modular container of claim 13, wherein the first and second sidewalls meet at a chamfer, the chamfer formed by a bottom portion.

18. The modular container of claim 13, wherein the first and second sidewalls meet at an angle, the angle being one of 60°, 72°, 90°, and 120°.

19. The modular container of claim 13, wherein three or more identical modular containers can be connected together in series to form a complete ring with openings facing outwardly and peripheral walls facing inwardly.

20. The complete ring of claim 19, wherein sidewalls of the peripheral walls of adjacent identical modular containers are in contact with one another to support a shape of the complete ring.

* * * * *